US007698783B2

(12) United States Patent
Heid

(10) Patent No.: US 7,698,783 B2
(45) **Date of Patent: *Apr. 20, 2010**

(54) HINGE

(75) Inventor: George E. Heid, Rockford, IL (US)

(73) Assignee: Newell Operating Company, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/040,569

(22) Filed: Feb. 29, 2008

(65) Prior Publication Data

US 2008/0141491 A1 Jun. 19, 2008

Related U.S. Application Data

(63) Continuation of application No. 11/084,263, filed on Feb. 25, 2005, now Pat. No. 7,346,959.

(60) Provisional application No. 60/548,845, filed on Feb. 27, 2004, provisional application No. 60/555,223, filed on Mar. 22, 2004.

(51) Int. Cl.
*E05D 7/04* (2006.01)

(52) U.S. Cl. ..... 16/242; 16/245; 16/271

(58) Field of Classification Search ..... 16/241–245, 16/248, 299–301, 236–238, 257, 259, 271, 16/258, 264; 24/617–618; 49/381, 420; 220/845, 826, 810, 843, 844
See application file for complete search history.

(56) References Cited

U.S. PATENT DOCUMENTS 375,038 A 12/1887 Wright
375,039 A 12/1887 Wright
386,186 A 7/1888 Dahlman
442,547 A 12/1890 Radler
794,454 A 7/1905 Davis et al.
843,081 A 2/1907 Fitgerald
863,128 A 8/1907 Aebi
880,317 A 2/1908 Ven De Marwitz
928,760 A 7/1909 Hunter
1,002,394 A 9/1911 Hanson
1,111,832 A 9/1914 Hazelrigg et al.
1,214,263 A 1/1917 Barber
1,314,732 A 9/1919 Cochran et al.
1,341,063 A 5/1920 McQueen
2,373,955 A 4/1945 Fuller
2,474,311 A 6/1949 Graham
2,588,258 A 3/1952 Lowman
2,683,279 A 7/1954 Okerlund et al.
2,913,200 A 11/1959 Paine, Jr. et al.
2,940,115 A 6/1960 Hansen
3,423,786 A 1/1969 Arias, Jr. et al.
3,475,784 A 11/1969 Foltx
3,584,332 A 6/1971 Taylor
3,613,150 A 10/1971 Osborn
3,618,993 A 11/1971 Platte (Continued)

*Primary Examiner*—Chuck Y. Mah
(74) *Attorney, Agent, or Firm*—Banner & Witcoff, Ltd.

(57) ABSTRACT

A hinge for a door is disclosed. The hinge comprises a receiver assembly having a slot, a door leaf having a retaining spring biased away from the door leaf, the door leaf being dimensioned for insertion into the slot and a retaining device associated with the receiver assembly for releasably engaging the retaining spring to releasably retain the door leaf in the slot.

23 Claims, 15 Drawing Sheets

U.S. PATENT DOCUMENTS

| | | | | | |
|---|---|---|---|---|---|
| 3,947,932 | A | * | 4/1976 | Flynn | 24/616 |
| 4,106,158 | A | | 8/1978 | Kellems et al. | |
| 4,141,109 | A | | 2/1979 | Farrell | |
| 4,142,272 | A | | 3/1979 | Oogami et al. | |
| 4,304,027 | A | | 12/1981 | DiFazio | |
| 4,330,901 | A | | 5/1982 | Sanders | |
| 4,386,646 | A | | 6/1983 | Maryas | |
| 4,434,523 | A | | 3/1984 | Grass | |
| 4,493,129 | A | | 1/1985 | Grass | |
| 4,571,774 | A | | 2/1986 | Hinson | |
| 4,590,642 | A | | 5/1986 | Hesener | |
| 4,639,971 | A | | 2/1987 | Kurtz | |
| 4,731,903 | A | * | 3/1988 | Kennedy et al. | 16/224 |
| 5,088,155 | A | * | 2/1992 | Grass | 16/257 |
| 5,568,673 | A | * | 10/1996 | Ryczek | 16/244 |
| 5,713,105 | A | | 2/1998 | Toomey | |
| 6,715,181 | B1 | | 4/2004 | Fries | |
| 7,331,085 | B2 | | 2/2008 | Heid | |
| 7,334,293 | B2 | | 2/2008 | Erickson et al. | |
| 2005/0188500 | A1 | | 9/2005 | Heid | |
| 2006/0179610 | A1 | | 8/2006 | Erickson et al. | |

* cited by examiner

HINGE

CROSS-REFERENCE TO RELATED APPLICATIONS

The present application is a continuation of U.S. patent application Ser. No. 11/084,263 (filed Feb. 25, 2005), issued as U.S. Pat. No. 7,346,959 (issued on Mar. 25, 2008), and claims the benefit thereof, which claims the benefit of provisional patent application No. 60/548,845, filed in the United States Patent and Trademark Office on Feb. 27, 2004, and provisional patent application No. 60/555,223, filed in the United States Patent and Trademark Office on Mar. 22, 2004.

FEDERALLY SPONSORED RESEARCH OR DEVELOPMENT

Not Applicable.

TECHNICAL FIELD

This invention relates to an adjustable hinge system, such as for a door.

BACKGROUND OF THE INVENTION

Adjustable hinges are desirable, as they permit adjustment as needed such as when a house settles. Typically such adjustable hinges have been complicated and have required multiple fastening components.

DETAILED DESCRIPTION OF A PREFERRED EMBODIMENT

Figure 1:
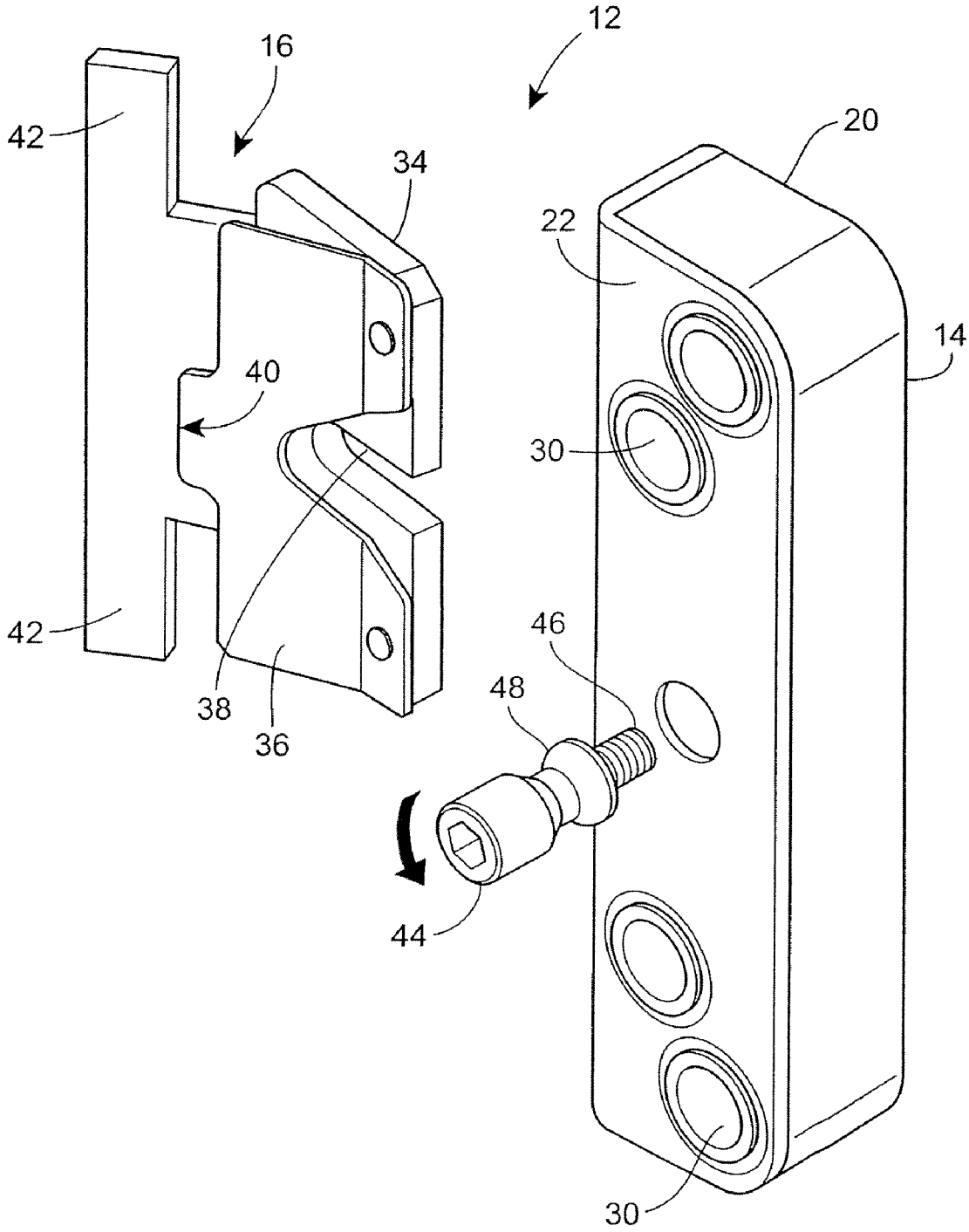
FIG. 1 is a perspective view of one embodiment of an adjustable hinge of the present invention.
Figure 2:
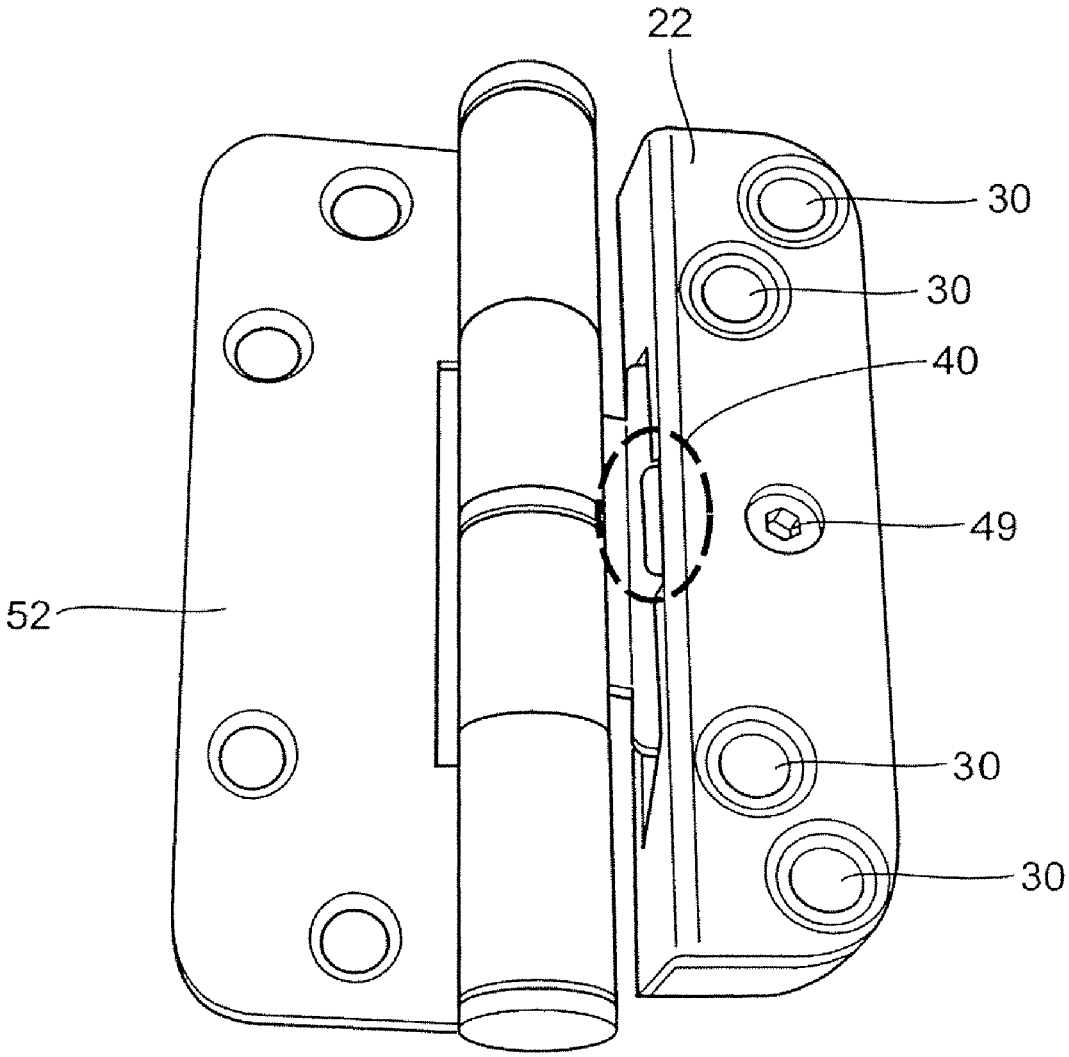
FIG. 2 is a front view of the adjustable hinge of FIG. 1.
Figure 3:
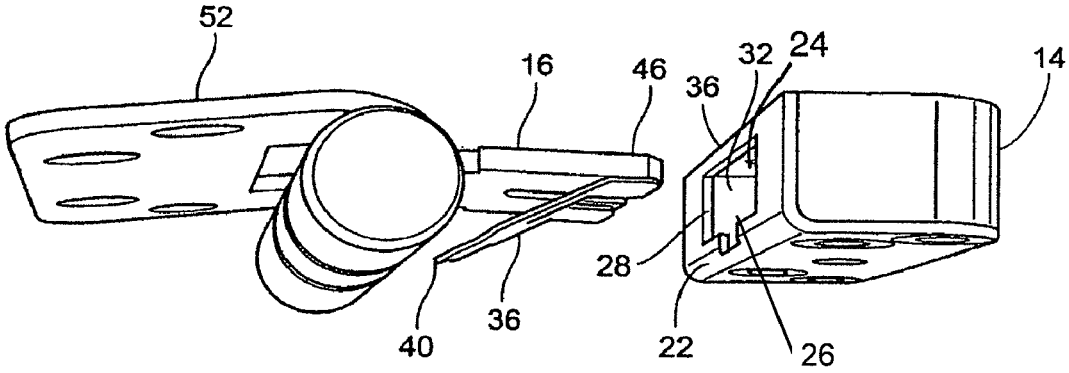
FIG. 3 is a generally top view of the hinge of FIG. 1.
Figure 4:
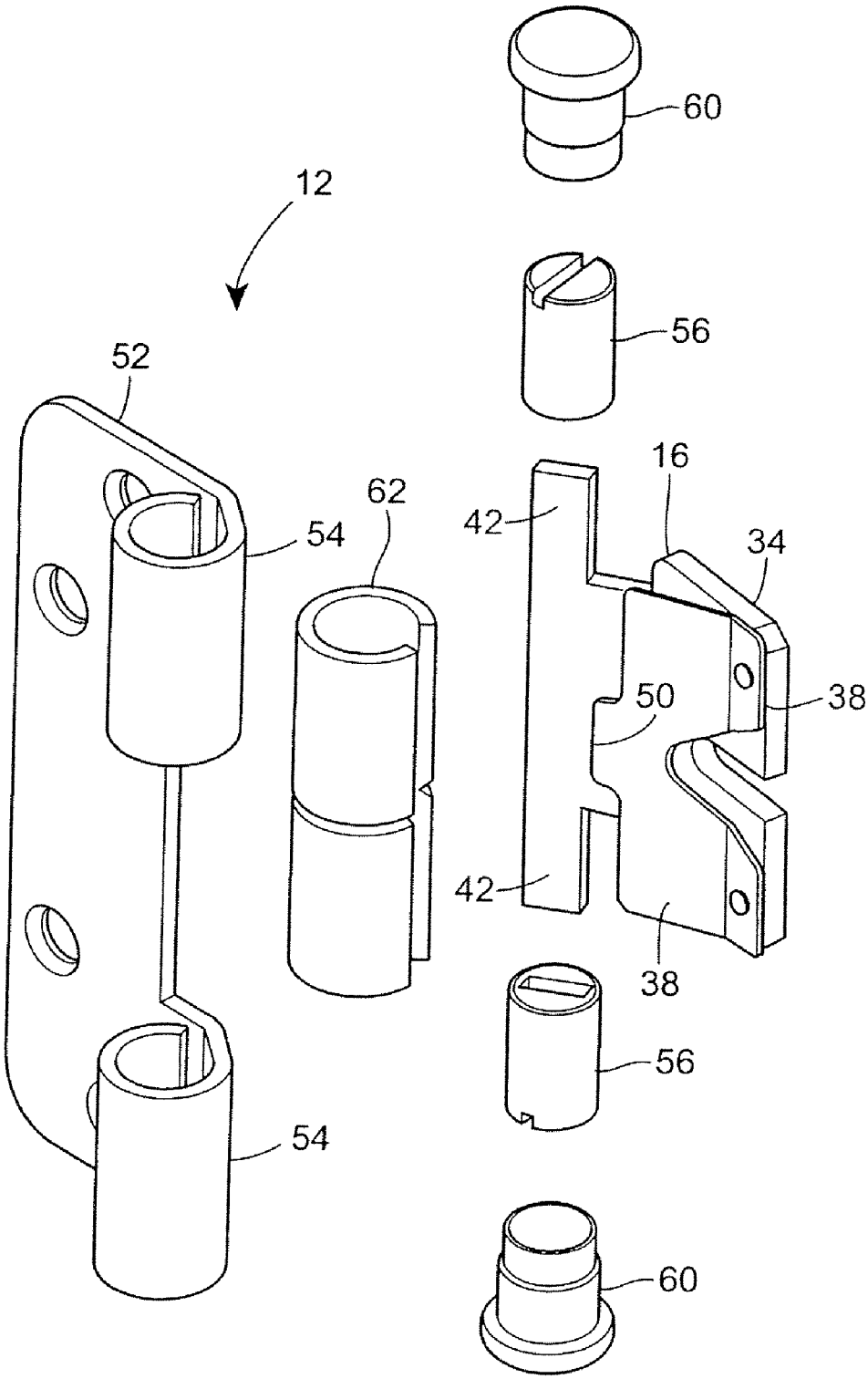
FIG. 4 is an exploded view of the hinge of FIG. 1, which hinge is not vertically adjustable.
Figure 5:
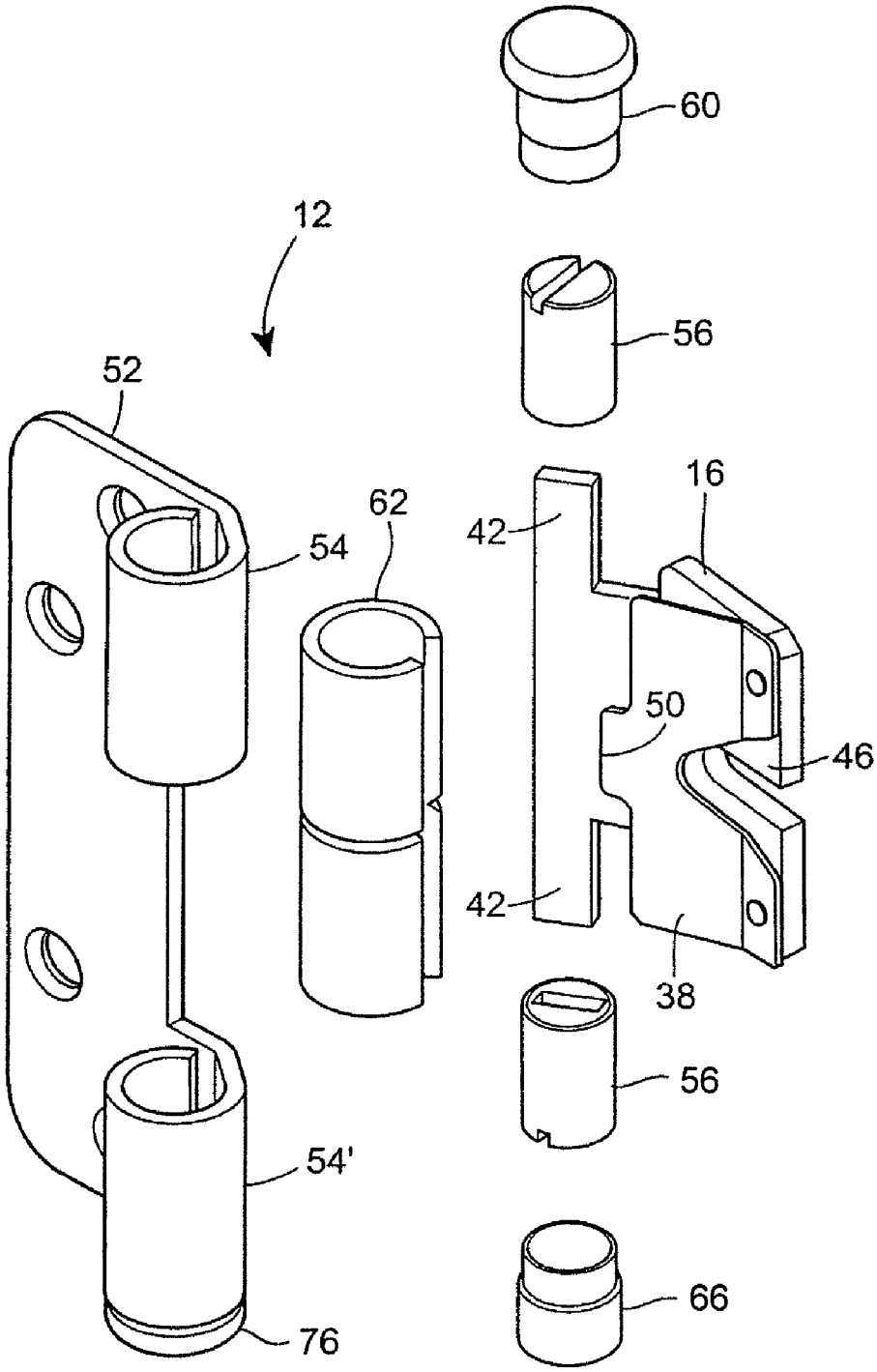
FIG. 5 is an exploded view of a the hinge of FIG. 1, which hinge is vertically adjustable.
Figure 6:
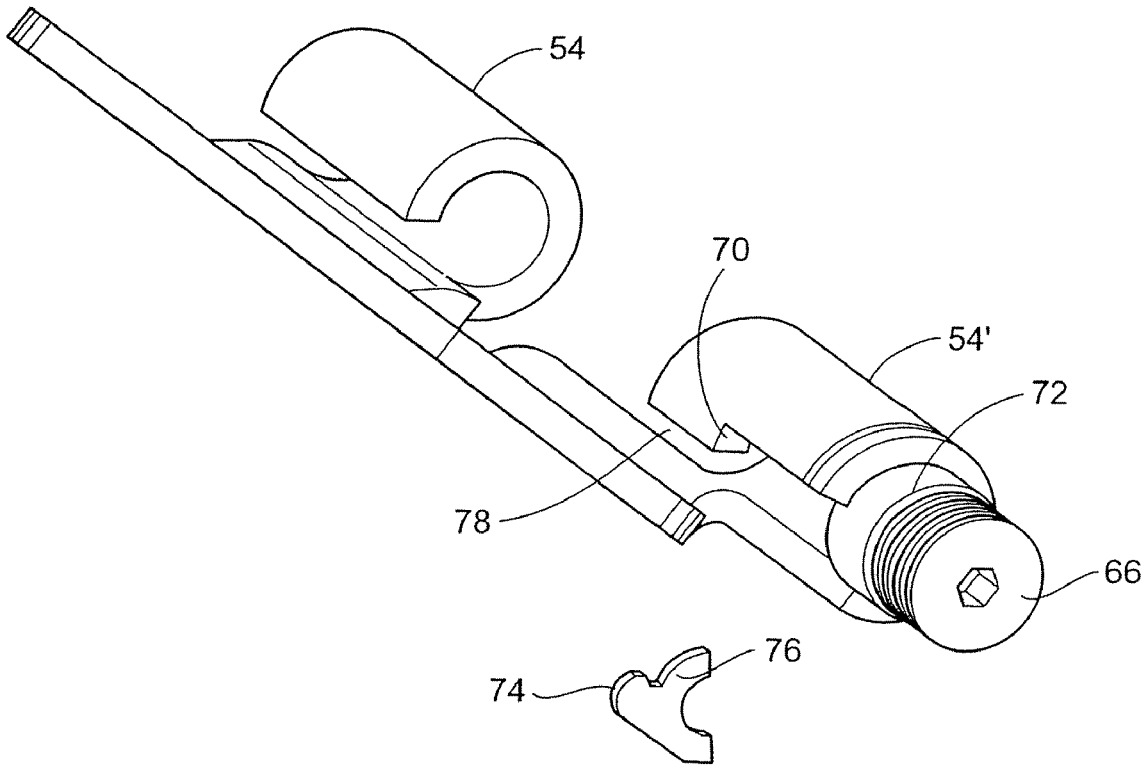
FIG. 6 is a perspective view of a frame wing of the vertically adjustable hinge of FIG. 5.
Figure 7:
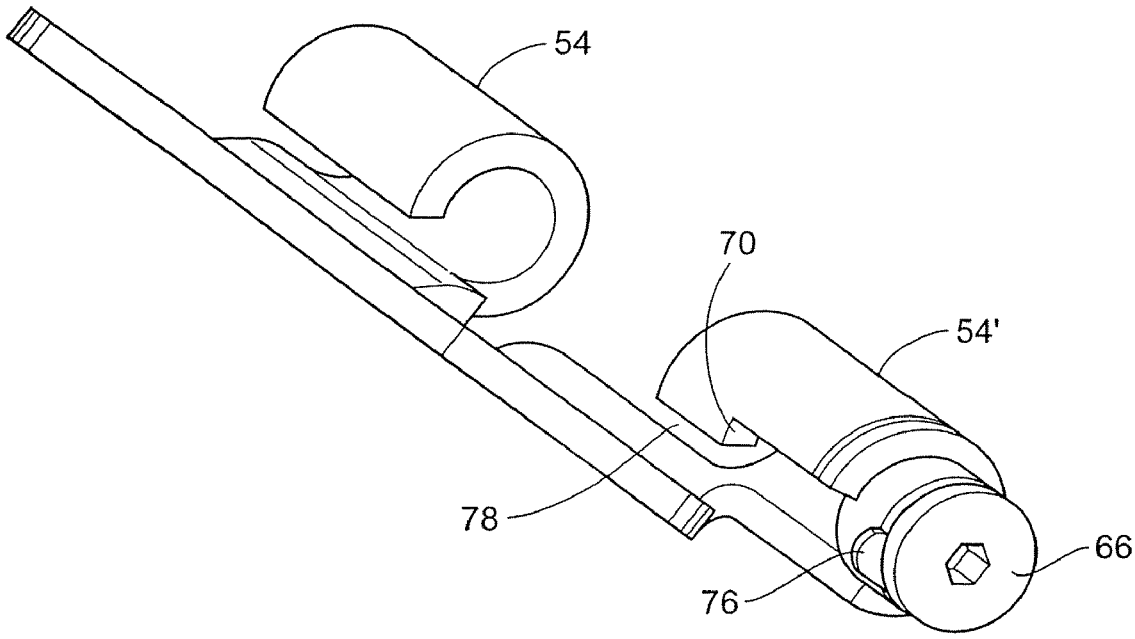
FIG. 7 is a further perspective view of a frame wing of the vertically adjustable hinge of FIG. 5.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiment illustrated.

A first embodiment of a horizontally adjustable hinge 12 is illustrated in FIGS. 1-4. The hinge 12 includes a receiver assembly 14 and a steel door leaf 16. The receiver assembly 14 includes a die cast housing 20 and a steel or brass cover 22. The housing 20 has a tapered slot 24 extending from a housing opening 26. The cover 22 has a slotted opening 28 aligned with, but slightly smaller than, the housing opening 32. The receiver assembly 14 includes four aligned holes 30 to receive screws (not shown) to secure the receiver assembly 14 to a door (not shown).

The door leaf 16 includes a slotted leaf 34 and a retaining spring 36. The retaining spring 36 is attached to, and extends from, the slotted leaf 34. The slotted leaf 34 has a leaf slot 38. The retaining spring 36 terminates with a release tab 40. The door leaf 20 further includes first and second opposed posts 42.

The slotted leaf 34 is inserted into the tapered housing slot 24. As the slotted leaf 34 is inserted, the retaining spring 36 is squeezed by the cover opening 28, until the spring 36 passes the cover opening 28, at which time the spring 36 expands, locking the slotted leaf 34 in the tapered slot 24. The slotted leaf 34 can be removed by depressing the tab 40, such as with a screw driver.

The hinge 12 includes an adjustment screw 44. The adjustment screw 44 includes a threaded portion 46 and a circumferential grooved portion 48. The threaded portion 46 is screwed into a cooperatively threaded hole 50 in the housing 20.

As the slotted leaf 34 is inserted into the tapered housing slot 24, the leaf slot 38 captures the grooved portion 48 of the adjustment screw 44. Rotation of the adjustment screw 44, such as with an Allen wrench, axially moves the adjustment screw 44, thereby horizontally moving the door leaf 16.

The hinge 12 further includes a steel frame wing 52 for attachment to a door frame (not shown). The frame wing 52 includes first and second opposed knuckles 54. Bearings 56 are placed over the first and second posts 42, which are then placed into respective first and second knuckles 54. Decorative steel end caps 60 are placed over outer openings of the knuckles 54. A decorative steel shroud 62 is disposed between the knuckles 54.

The hinge 12 can also be vertically adjustable, as illustrated in FIGS. 5-8.

To make the hinge 12 vertically adjustable, the bottom one of the knuckles 54' is internally threaded to receive an externally threaded vertical positioning screw 66. Rotation of the vertical positioning screw 66 vertically adjusts the door leaf 34 relative to the frame wing 52. The decorative end cap 60 is placed over the opening of the other knuckle 54. Which knuckle is threaded depends upon whether the hinge is to be a right hand hinge or a left hand hinge.

Such vertical adjustment systems are known, but have been subject to a problem of having the vertical positioning screw 66 lock when it is rotated past the threads of the threaded knuckle 54'.

Figure 8:
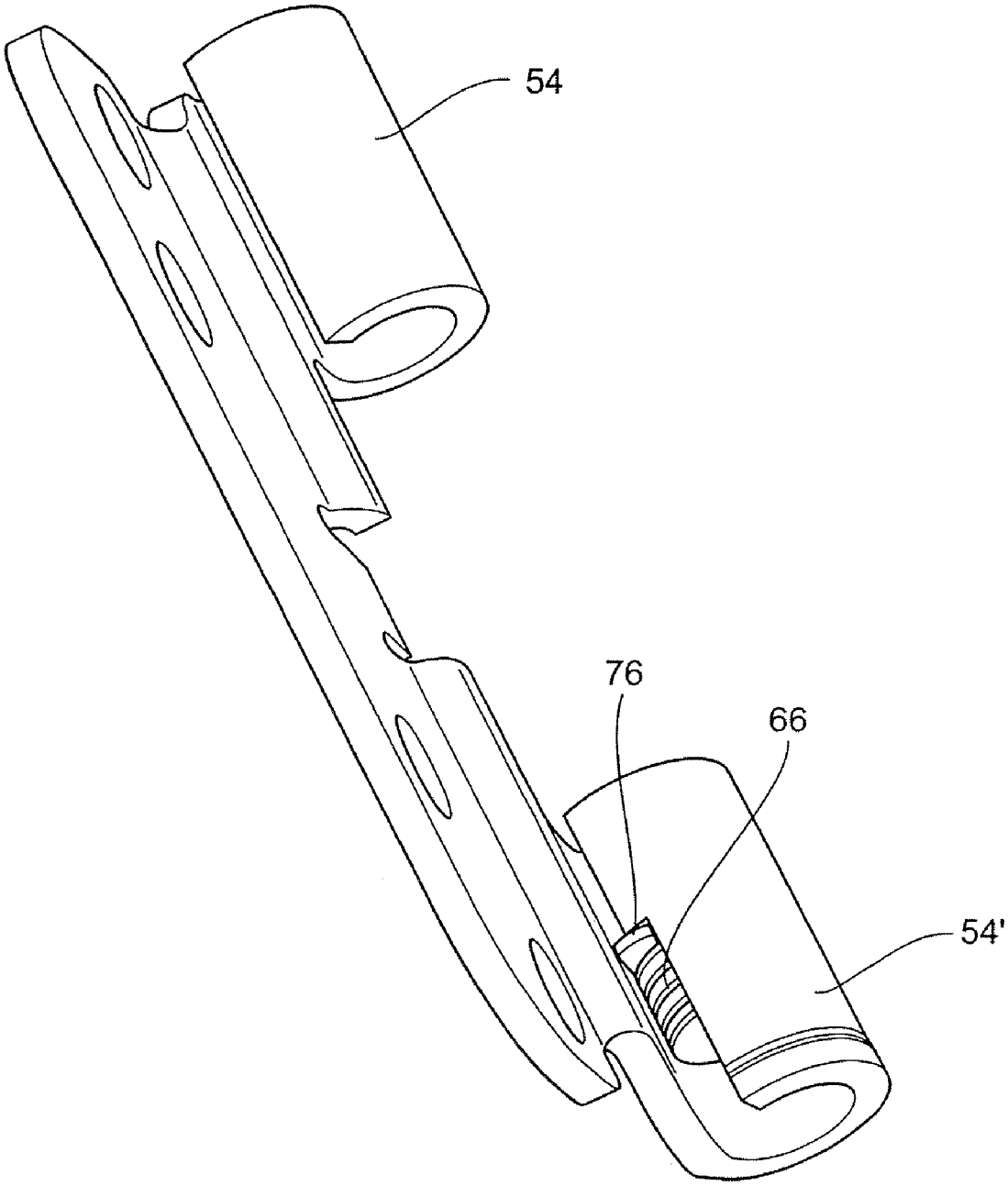
FIG. 8 is a further perspective view of a frame wing of the vertically adjustable hinge of FIG. 5.
Figure 9:
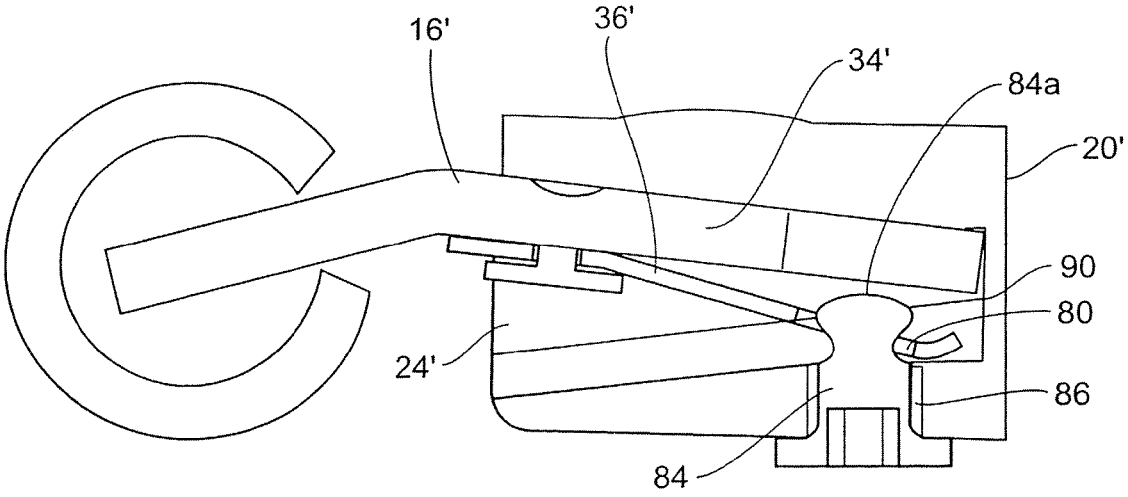
FIG. 9 is a sectional view of a hinge having an alternative arrangement for securing the door leaf to the housing.
Figure 10:
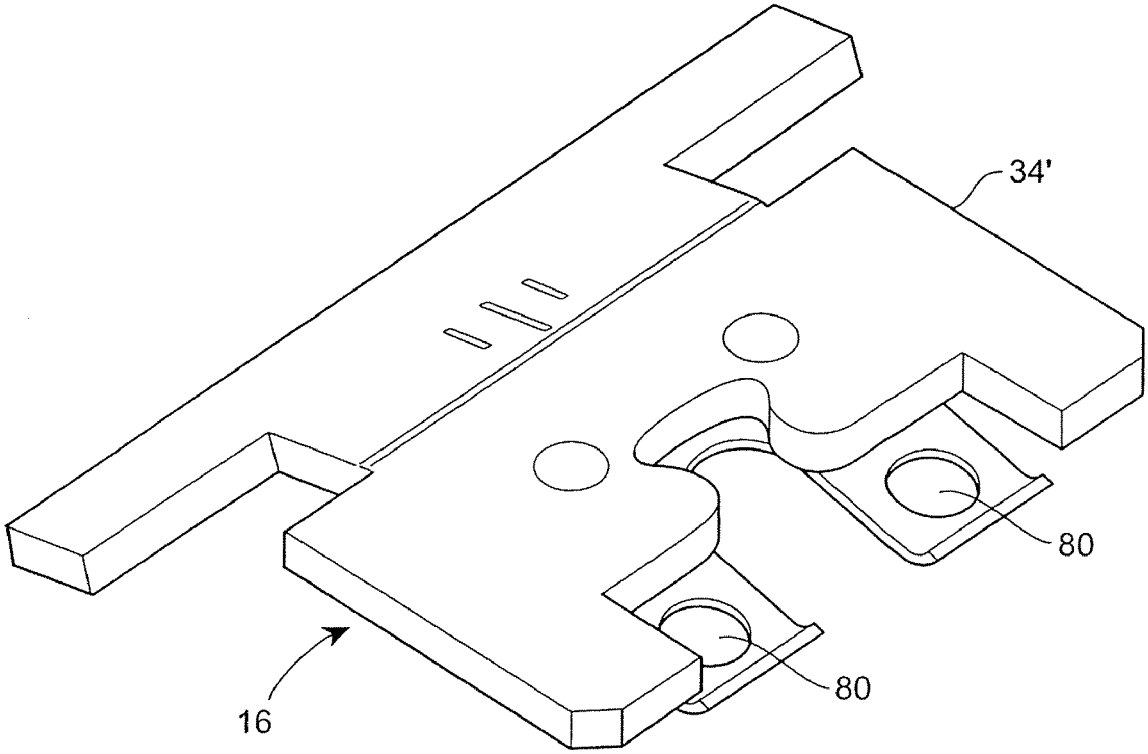
FIG. 10 is a perspective view of a door leaf of the embodiment of FIG. 9.

In accordance with this aspect of the invention, the threaded knuckle 54' is provided with a stop surface 70. The vertical positioning screw 66 includes a circumferential groove 72, which receives a wing stop 74. The wing stop 74 is preferably formed of steel, and includes a stop tab 76. As the vertical positioning screw 66 is rotated into the threaded knuckle 54', the stop tab 76 travels along a knuckle slot 78, until the stop tab 76 ultimately engages, and is blocked by, the stop surface 70, as illustrated in FIG. 8.

Figure 11:
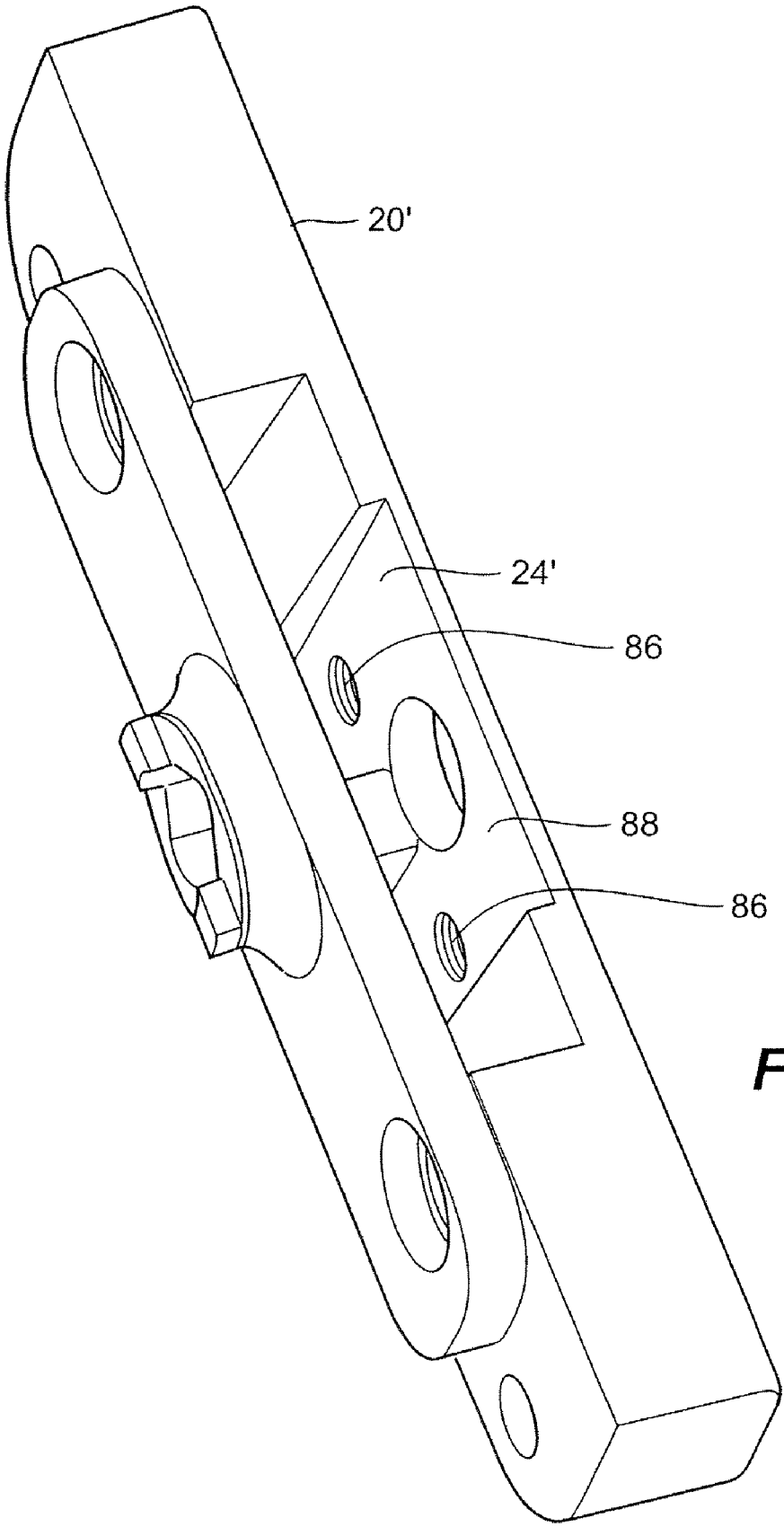
FIG. 11 is a perspective view of a spring pocket of the embodiment of FIG. 9.
Figure 12:
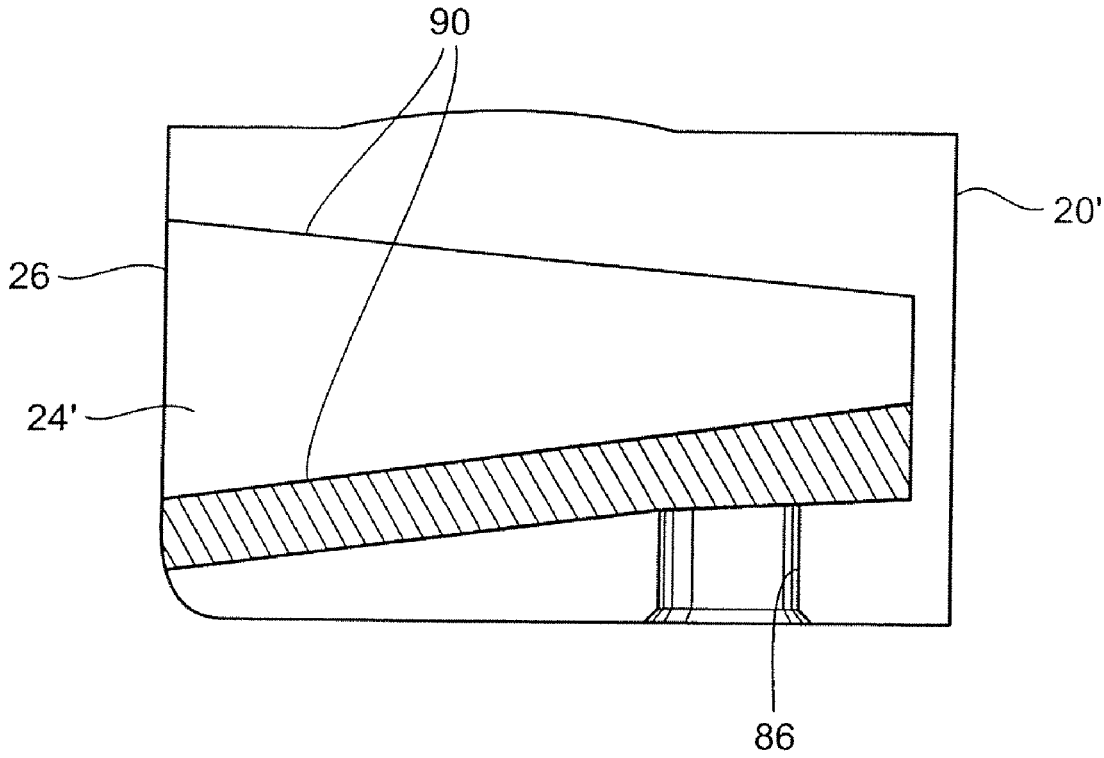
FIG. 12 is a sectional view of a spring pocket of the embodiment of FIG. 9.

A second embodiment of a system for retaining a door leaf 16' in a modified housing 20', using a modified retaining spring 36", having spring apertures 80, is illustrated in FIGS. 9-12. As discussed below, other changes include two threaded release pins 84 for insertion in corresponding threaded passages 86 in the housing 20'. In addition, a modified tapered slot 24' includes a pocket 88 along opposed walls 90 of the modified tapered slot 24'. The pocket 88 is best seen in FIGS. 11 and 12.

As the retaining spring 36' is inserted into the tapered slot 24', a distal portion of the spring 36' passes over tips 84*a* of the release pins 84, until the tips 84*a* of the release pins 84 extend into the spring apertures 80, locking the slotted leaf 34' in the housing 20'. In order to subsequently remove the slotted leaf 34' from the housing 20', the release pins 84 are first unthreaded from the housing 20', and the slotted leaf 34' is slid out of the tapered slot 24'.

As best seen in FIGS. 11 and 12, the tapered slot 24' includes the pocket 88, dimensioned to receive the spring 36' when the slotted leaf 34' is drawn towards the wall 90, providing precise horizontal positioning of the slotted leaf 34.

A second embodiment of a horizontal hinge adjustment system for an adjustable hinge 12' is illustrated in FIGS. 13-16. The adjustable hinge 12' includes a receiver assembly 14', a stop plate 92 and a cover 22', collectively to be mounted to a door (not shown). The adjustable hinge 12' further includes a slotted leaf 34. The slotted leaf may be either of the above-described slotted leafs.

The hinge 12' includes a horizontal adjustment screw 94, preferably formed of stainless steel. The horizontal adjustment screw 94 is threaded into a threaded passage of a horizontal adjustment nut 96. The horizontal adjustment nut 96 is preferably formed of steel. As the horizontal adjustment screw 94 is rotated, the horizontal adjustment nut 96 moves axially along the horizontal adjustment screw 94. The horizontal adjustment nut 96 has a generally squared portion 96*a*, which fits into a complementarily shaped portion 14*a* in the receiver assembly 14', to prevent rotation of the horizontal adjustment nut 96.

The horizontal adjustment nut 96 includes a circumferential grooved portion 46 to receive the leaf slot 38' in the door leaf 34.

Figure 13:
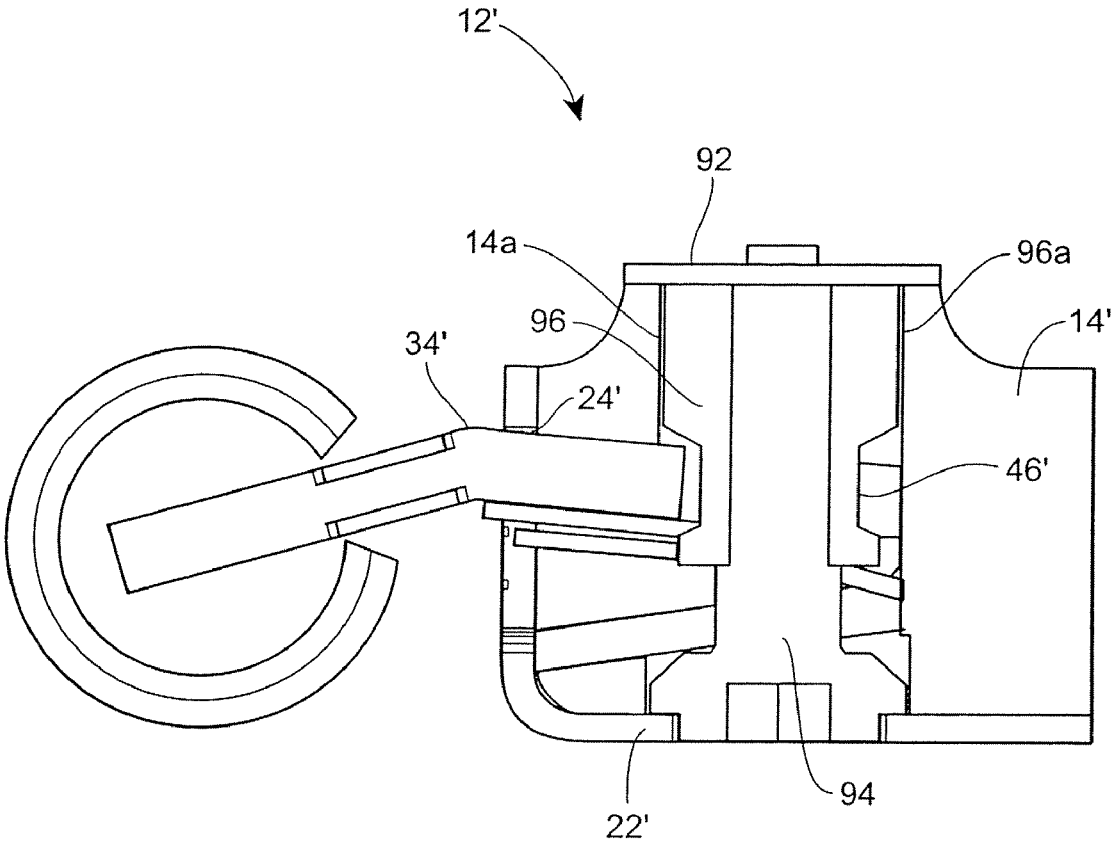
FIG. 13 is a sectional view of a hinge having an alternative arrangement for horizontally adjusting the hinge.
Figure 14:
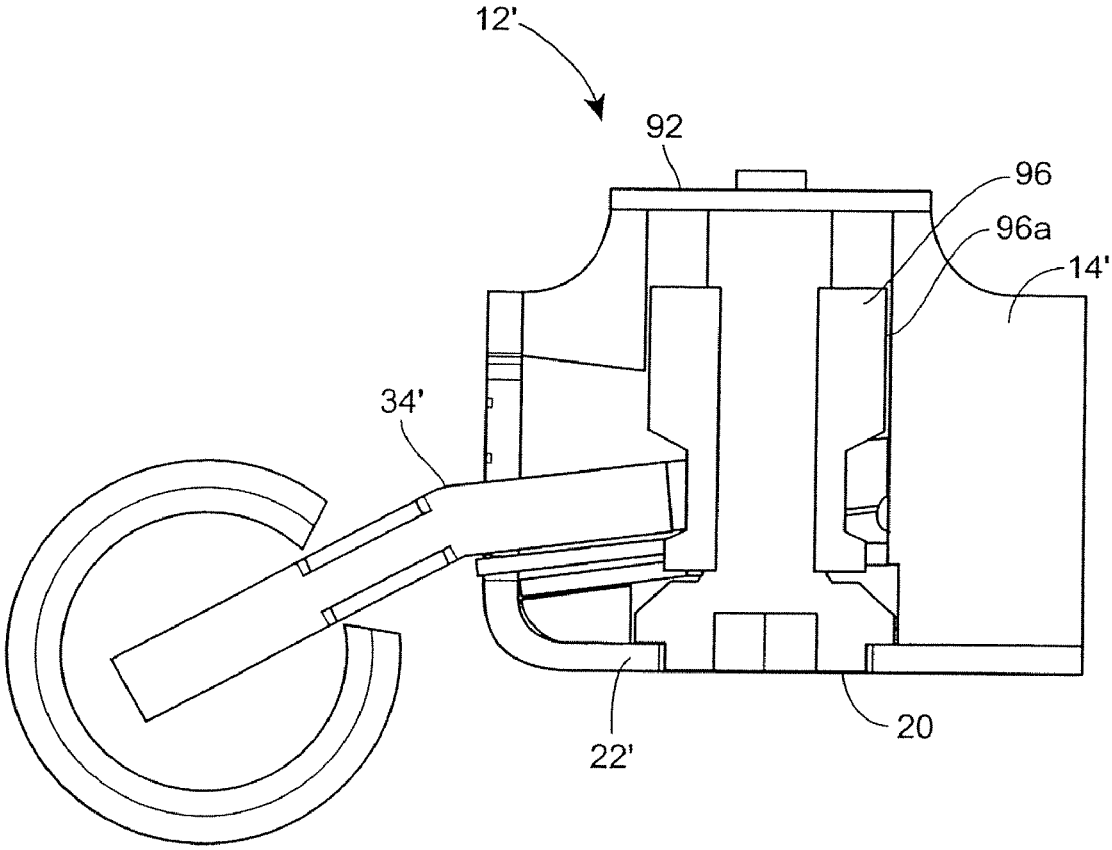
FIG. 14 is a further sectional view of the embodiment of FIG. 13.
Figure 15:
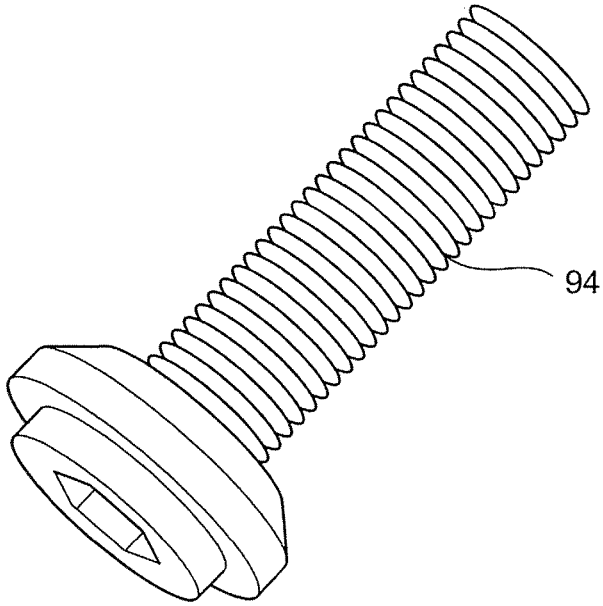
FIG. 15 is a perspective view of an adjustment screw as used in the embodiment of FIG. 13.
Figure 16:
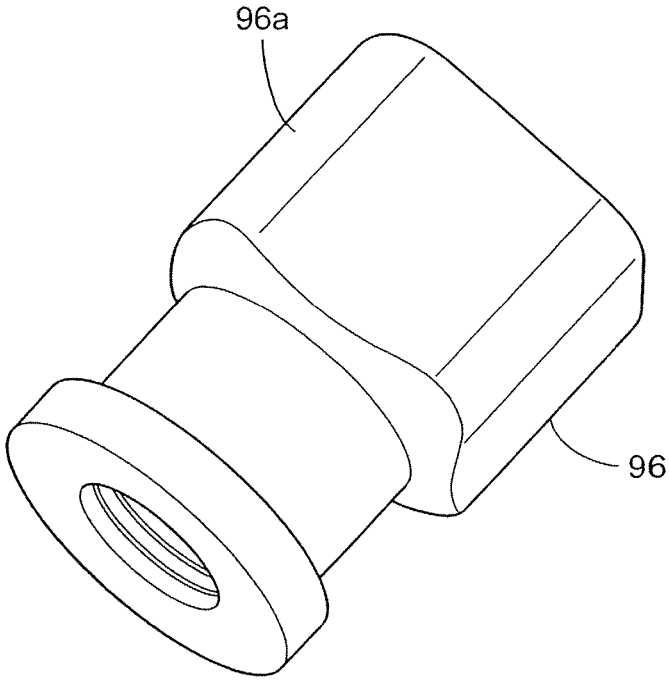
FIG. 16 is a perspective view of an adjustment nut as used in the embodiment of FIG. 13.

Rotation of the horizontal adjustment screw 94 in a first direction moves the door leaf 34' to a first horizontal position, as shown in FIG. 13. Rotation of the horizontal adjustment screw 94 in a second, opposite direction moves the door leaf 34' to a second horizontal position, as shown in FIG. 14.

The groove in the adjustment nut and the slot of the slotted leaf are sized to minimize play between the components during adjustment. The centerline of the slot of the slotted leaf and the centerline of the adjustment nut will be coincident in the nominal position.

The horizontal positioning feature and the vertical positioning feature can be implemented in a single hinge. Alternatively, a hinge may include only one of the features. It is believed to be more desirable to the end consumer to utilize, in a three hinge system, horizontally adjustable hinges as the upper and lower hinges, and a vertically adjustable hinge as the center hinge.

If a hinge only includes the vertical adjustment feature, no horizontal adjustment screws are required. To cover the opening for the adjustment screw, a cover solid at that location can be provided.

What is claimed is:

1. An assembly comprising:

a receiver assembly having a cavity therein, the receiver assembly further having an opening providing access to the cavity;

a leaf dimensioned for insertion into the cavity in an insertion direction and adapted for connection to a second leaf and a retaining spring connected to the leaf and extending away from the leaf, wherein the retaining spring is moveable between a compressed position and an expanded position, wherein when the retaining spring is in the compressed position, the leaf is able to be inserted into the cavity and removed from the cavity through the opening, and when the leaf is received in the cavity and the retaining spring is in the expanded position, the spring engages an interior surface of the receiver assembly to retain the leaf within the receiver assembly, the interior surface being located inwardly of the opening and extending into the cavity in a direction transverse to the insertion direction.

2. The assembly of claim 1, wherein the retaining spring has an exposed tab to facilitate movement of the spring from the expanded position to the compressed position.

3. The assembly of claim 2, wherein the opening has a slot, and the exposed tab of the retaining spring is received in the slot to facilitate access to the tab.

4. The assembly of claim 1, wherein the receiver assembly comprises a cover having the opening therein, and the interior surface is defined on an interior side of the cover.

5. The assembly of claim 1, wherein the opening is smaller than a cross-sectional area of the cavity.

6. The assembly of claim 1, wherein the receiver assembly comprises a flange surrounding at least a portion of the opening, and the interior surface is defined on an interior side of the flange.

7. The assembly of claim 1, wherein the spring has a fixed end connected to the leaf and a free end distal from the leaf, wherein the free end engages the interior surface of the receiver assembly to retain the leaf within the receiver assembly.

8. A stop mechanism for a vertically adjustable hinge including a wing having a knuckle with a stop surface and a threaded axial bore and a leaf having a post dimensioned for insertion into the bore, the stop mechanism comprising:

a threaded adjustment screw adapted to be threaded into the axial bore, the adjustment screw further being adapted to engage the post of the leaf when the post is inserted into the bore such that the position of the leaf relative to the wing is determined by the position of the adjustment screw relative to the knuckle; and a stop engaging the adjustment screw such that the screw rotates independently of the stop and the screw and the stop move together linearly, the stop having a tab thereon, wherein rotational movement of the screw causes simultaneous linear movement of the screw and stop such that the screw and the stop are adapted to move axially along the axial bore, wherein the tab is adapted to engage the stop surface to prevent further travel of the adjustment screw along the axial bore.

9. The stop mechanism of claim 8, wherein the stop is a wing stop engaging the outer surface of the adjustment screw.

10. The stop mechanism of claim 8, wherein the adjustment screw includes a circumferential groove and a portion of the stop is received in the circumferential groove.

11. The stop mechanism of claim 8, wherein the tab extends from the stop such that the tab is adapted to be received by, and travel axially within, a slot adjacent to the axial bore, the slot having the stop surface defined thereon.

12. An assembly comprising:

a wing having a knuckle, the knuckle having a threaded axial bore and a stop surface, the knuckle being adapted for connection to a leaf to form a hinge, wherein the knuckle is adapted to receive a post of the leaf therein;

an adjustment screw threaded into the axial bore and adapted to engage the post of the leaf when the post is inserted into the bore such that the position of the leaf relative to the wing is determined by the position of the adjustment screw relative to the knuckle; and a stop engaging the adjustment screw, wherein rotational movement of the screw causes simultaneous axial movement of the screw and stop along the axial bore, wherein a portion of the stop is engageable with the stop surface to prevent further travel of the adjustment screw along the axial bore.

13. The assembly of claim 12, wherein the wing further comprises a second knuckle adapted to receive a second post of the leaf therein.

14. The assembly of claim 12, wherein the stop is a wing stop engaging the outer surface of the adjustment screw.

15. The assembly of claim 12, wherein the adjustment screw includes a circumferential groove and a second portion of the stop is received in the circumferential groove.

16. The assembly of claim 12, wherein the stop has a tab that is engageable with the stop surface to prevent further travel of the adjustment screw along the axial bore.

17. The assembly of claim 16, wherein the knuckle further comprises a slot adjacent to the axial bore, the stop surface being disposed along the slot, and wherein the tab is positioned to travel along the slot as the stop moves along the axial bore.

18. The assembly of claim 12, wherein the knuckle further comprises a slot adjacent to the axial bore, the stop surface being disposed along the slot.

19. The assembly of claim 18, wherein the portion of the stop that is engageable with the stop surface is dimensioned to be received in the slot and to travel along the slot as the stop moves along the axial bore.

20. An adjustable assembly comprising:

a knuckle having a threaded axial bore therethrough, the knuckle comprising a slot adjacent to the axial bore and a stop surface disposed along the slot;

an adjustment screw threaded into the axial bore; and a stop engaging the adjustment screw such that rotational movement of the screw causes simultaneous axial movement of the screw and the stop along the axial bore, the stop having a tab positioned to travel along the slot as the stop moves linearly, wherein the tab is engageable with the stop surface to prevent further travel of the adjustment screw along the axial bore.

21. The assembly of claim 20, wherein the stop is a wing stop engaging the outer surface of the adjustment screw.

22. The assembly of claim 20, wherein the adjustment screw includes a circumferential groove and a portion of the stop is received in the circumferential groove.

23. The assembly of claim 20, wherein the knuckle is a component of a wing adapted for connection to a leaf to form a hinge assembly, wherein the knuckle is adapted to receive a post of the leaf therein.

* * * * *